United States Patent [19]

Seanor

[11] Patent Number: 4,641,956

[45] Date of Patent: Feb. 10, 1987

[54] EXTENDED NIP CLEANING SYSTEM

[75] Inventor: Donald A. Seanor, Pittsford, N.Y.

[73] Assignee: Xerox Corporation, Stamford, Conn.

[21] Appl. No.: 180,791

[22] Filed: Aug. 25, 1980

[51] Int. Cl.[4] ..... G03G 21/00

[52] U.S. Cl. ..... 355/15; 355/3 BE; 118/652; 15/256.5

[58] Field of Search ..... 355/15, 3 BE; 118/652; 15/256.5, 1.5; 134/1, 7, 9; 198/494, 498

[56] References Cited

U.S. PATENT DOCUMENTS

| | | | |
|---|---|---|---|
| 3,276,896 | 10/1966 | Fisher | 430/119 |
| 3,510,903 | 5/1970 | Stoever et al. | 15/256.5 |
| 3,580,673 | 5/1971 | Yang | 355/15 |
| 3,592,675 | 7/1971 | Cheng | 134/7 |
| 3,713,736 | 1/1973 | Sargis | 355/15 |
| 4,013,041 | 3/1977 | Armstrong | 118/656 |
| 4,096,826 | 6/1978 | Stange | 118/656 |
| 4,108,546 | 8/1978 | Rezanka | 355/15 |
| 4,230,406 | 10/1980 | Klett | 355/15 |
| 4,272,184 | 6/1981 | Rezanka | 355/15 |

OTHER PUBLICATIONS

*Xerox Disclosure Journal,* vol. 1, No. 4, Apr. '76, pp. 77, 78.

*Primary Examiner*—R. L. Moses

*Attorney, Agent, or Firm*—H. Fleischer; J. E. Beck; R. Zibelli

[57] ABSTRACT

An apparatus in which a cleaning material is transported into contact with particles adhering to a flexible member in a cleaning zone. The flexible member is maintained at a pre-selected tension. During cleaning, the flexible member is deflected to form an extended cleaning zone.

20 Claims, 4 Drawing Figures

EXTENDED NIP CLEANING SYSTEM

This invention relates to an electrophotographic printing machine, more particularly concerns an improved cleaning system for use therein.

In electrophotographic printing, a photoconductive member is charged to sensitize the surface thereof. The charged photoconductive member is exposed to a light image of an original document being reproduced. Exposure of the sensitized photoconductive surface discharges the charge selectively. This records an electrostatic latent image on the photoconductive surface corresponding to the informational areas contained within the original document being reproduced. Development of the electrostatic latent image recorded on the photoconductive surface is achieved by bringing a developer material into contact therewith. Typical developer materials comprise a heat settable plastic powder, known in the art as toner particles, which adhere triboelectrically to coarser magnetic granules, such as ferromagnetic granules. The toner particles are selected to have the appropriate charge relative to the electrostatic latent image recorded on the photoconductive surface. When the developer material is brought into contact with the latent image recorded on the photoconductive surface, the greater attractive force thereof causes the toner particles to transfer from the carrier granules to the electrostatic latent image.

Frequently, residual toner particles remain adhering to the photoconductive surface after the transfer thereof to the sheet of support material. Hereinbefore, ordinary cleaning devices such as webs, brushes or foam rollers, have not been entirely satisfactory in cleaning residual particles from the photoconductive surface. One of the more attractive methods for cleaning particles from the photoconductive surface has been to use a rotating magnet enclosed in a stationary, non-magnetic shell, or alternatively, to utilize stationary magnets enclosed within a rotating, non-magnetic shell. This system attracts carrier granules which, in turn, attract the residual toner particles from the photoconductive surface thereto. One of the problems associated with a cleaning system of this type is that the present designs are costly and somewhat complex in order to achieve the desired cleaning efficiency. Various types of techniques have been employed previously. The following disclosures appear to be relevant:

U.S. Pat. No. 3,276,896
Patentee: Fisher
Issued: Oct. 4, 1966
U.S. Pat. No. 3,580,673
Patentee: Yang
Issued: May 25, 1971
U.S. Pat. No. 3,713,736
Patentee: Sargis
Issued: Jan. 30, 1973
U.S. Pat. No. 4,013,041
Patentee: Armstrong et al.
Issued: Mar. 22, 1977
U.S. Pat. No. 4,096,826
Patentee: Stange
Issued: June 27, 1978
U.S. Pat. No. 4,108,546
Patentee: Rezanka
Issued: Aug. 22, 1978
Co-pending application Ser. No. 111,450
Applicant: Kopko et al. Filed: Jan. 11, 1980
Co-pending application Ser. No. 169,543
Applicant: Hatch
Filed: July 14, 1980

The pertinent portions of the foregoing disclosures may be briefly summarized as follows:

Fisher discloses a washing roller having a flexible photoreceptor guided thereover by a transport roller. An extended nip is formed about the washing roller.

Yang describes an apparatus for cleaning particles from a recording surface. The apparatus includes a rotatably mounted non-magnetic cylindrical member housing a permanent bar magnet. The cylindrical member moves magnetic beads into contact with the recording surface. An electrical bias opposite in polarity to the polarity of the toner particles is applied thereto. The electrical bias is sufficient to attract the toner particles to the cleaning beads. A conductive roll is positioned in contact with the magnetic beads. The roll is electrically biased to the same polarity as the cylindrical member with the magnitude thereof being sufficiently high to attract the toner particles from the cleaning beads thereto.

Sargis discloses a toner removal apparatus including a container partially filled with magnetizable particles. A hollow cleaning roller is mounted therein for rotation about a permanent magnet. Toner particles clinging to the photoconductive belt are attracted by triboelectric forces to the magnetizable particles covering the surface of the cleaning roller. A pair of auxiliary rollers are disposed in the container to distribute the toner laden magnetic particles throughout the particles in the container. The cleaning roller may be electrically charged to cause the attraction of toner particles to the cleaning roller. Electrical charge may be provided by a power supply coupled to the cleaning roller.

Armstrong et al. discloses an electrophotographic printing machine having a magnetic brush developer roller contacting one side of a flexible photoconductive belt. As shown in FIG. 3, guide rollers maintain a portion of the belt in a slackened condition so that the belt is capable of moving freely toward and away from the developer roller in response to the varying contours thereof.

Stange discloses a magnetic brush development system in which a deflection device moves the image bearing surface of a flexible member into contact with the magnetic fibers of the magnetic brush developer assembly.

Rezanka describes an extended cleaning nip through the use of a cleaning web or deformable cleaning roller engaging a photoconductive drum.

Kopko et al. describes an electrophotographic printing machine in which developer material on a developer roller deforms a tensioned photoconductive belt so as to space the developer roller from the belt.

Hatch describes a development system in which a developer roller transports developer material into contact with a photoconductive belt. The developer material being transported into contact with the photoconductive belt spaces the belt from the developer roller. The thickness of the layer of developer material on the developer roller is adjustable to control the spacing between the belt and developer roller.

In accordance with the features of the present invention, there is provided an apparatus for removing particles from a flexible member. Means transport a cleaning material into contact with the particles adhering to the flexible member in a cleaning zone. Means are provided for maintaining the flexible member at a pre-selected tension of sufficient magnitude so that the flexible member deflects about the transporting means to form an extended cleaning zone between the transporting means and the flexible member.

Other aspects of the present invention will be apparent as the following description proceeds and upon reference to the drawings, in which.

While the present invention will hereinafter be described in connection with a preferred embodiment thereof, it will be understood that it is not intended to limit the invention to the embodiment. On the contrary, it is intended to cover all alternatives, modifications and equivalents as may be included within the spirit and scope of the invention as defined by the appended claims.

Figure 1:
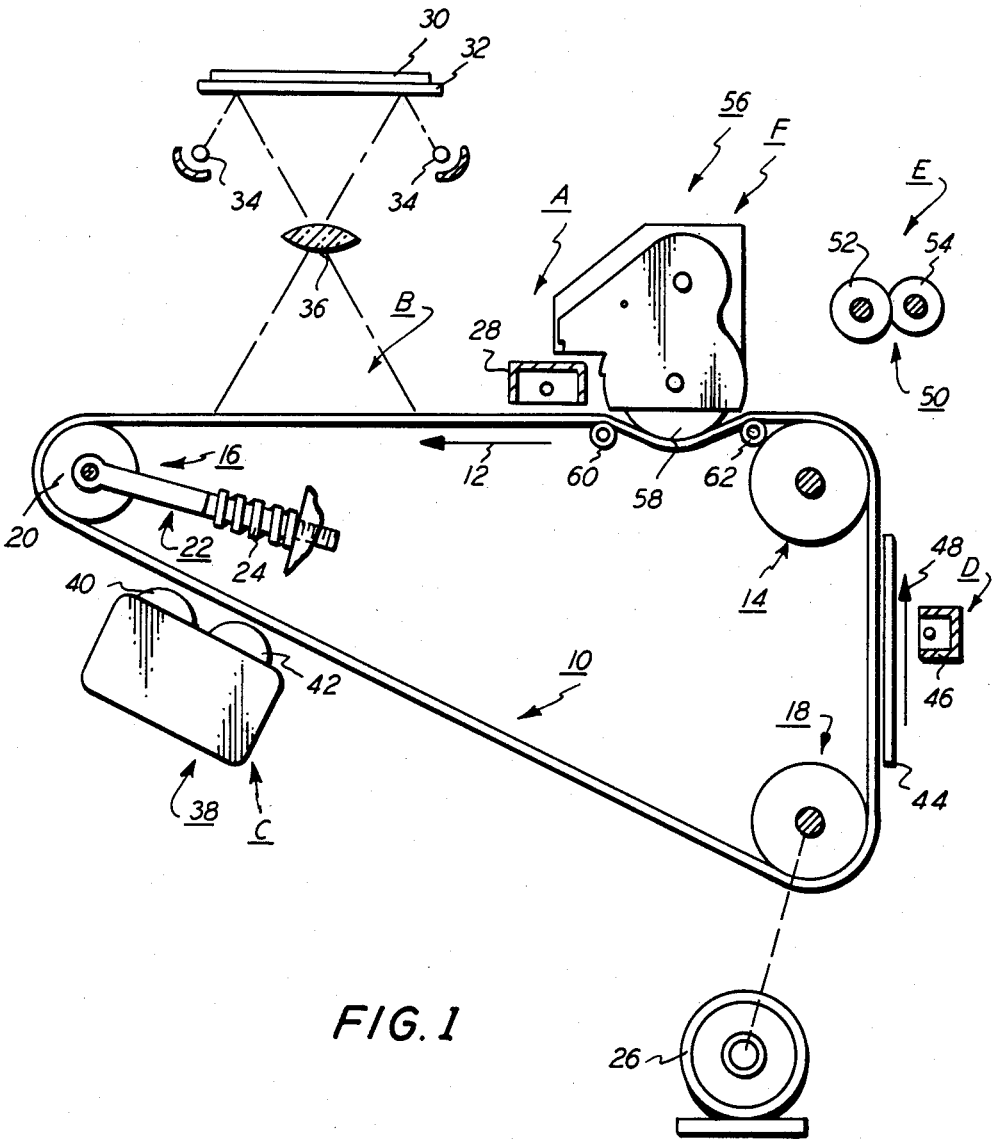
FIG. 1 is a schematic elevational view depicting an electrophotographic printing machine incorporating the features of the present invention therein.

For a general understanding of the illustrative electrophotographic printing machine incorporating the features of the present invention, reference is made to the drawings. In the drawings, like reference numerals have been used throughout to designate identical elements. FIG. 1 schematically depicts the various components of an electrophotographic printing machine employing the cleaning system of the present invention therein. Although this cleaning system is particularly well adapted for use in the illustrative electrophotographic printing machine, it will become evident from the following discussion that it is equally well suited for use in a wide variety of electrostatographic printing machines and is not necessarily limited in its application to the particular embodiment shown herein.

Inasmuch as the art of electrophotographic printing is well known, the various processing stations employed in the FIG. 1 printing machine will be shown hereinafter schematically, and their operation described briefly with reference thereto.

As shown in FIG. 1, the electrophotographic printing machine employs a belt 10 having a photoconductive surface deposited on a conductive substrate. Preferably, the photoconductive surface comprises a transport layer containing small molecules of m-TDB dispersed in a polycarbonate and a generation layer of trigonal selenium. The conductive substrate is made preferably from aluminized Mylar electrically grounded. Belt 10 moves in the direction of arrow 12 to advance successive portions of the photoconductive surface sequentially through the various processing stations disposed about the path of movement thereof. The path of movement of belt 10 is defined by stripping roller 14, tensioning system 16 and drive roller 18. As depicted in FIG. 1, tensioning system 16 includes a roller 20 over which belt 10 moves. Roller 20 is mounted rotatably in yoke 22. Spring 24, which is initially compressed, resiliently urges yoke 22 in a direction such that roller 20 presses against belt 10. The level of tension is relatively low permitting belt 10 to be easily deflected. The detailed structure of the tensioning system will be described hereinafter with reference to FIG. 2. With continued reference to FIG. 1, drive roller 18 is mounted rotatably and in engagement with belt 10. Motor 26 rotates roller 18 to advance belt 10 in the direction of arrow 12. Roller 18 is coupled to motor 26 by suitable means such as a belt drive. Stripping roller 14 is freely rotatable so as to permit belt 10 to move in the direction of arrow 12 with a minimum of friction.

Initially, a portion of belt 10 passes through charging station A. At charging station A, a corona generating device, indicated generally by the reference numeral 28, charges the photoconductive surface of belt 10 to a relatively high, substantially uniform potential.

Next, the charged portion of the photoconductive surface is advanced through exposure station B. At exposure station B, an original document 30 is positioned face down upon a transparent platen 32. Lamps 34 flash light rays onto original document 30. The light rays reflected from original document 30 are transmitted through lens 36 forming a light image thereof. Lens 36 focuses the light image onto the charge portion of the photoconductive surface to selectively dissipate the charge thereon. This records an electrostatic latent image on the photoconductive surface which corresponds to the informational areas contained within original document 30.

Thereafter, belt 10 advances the electrostatic latent image recorded on the photoconductive surface to development station C. At development station C, a magnetic brush development system, indicated generally by the reference numeral 38, advances a developer material into contact with the electrostatic latent image recorded on the photoconductive surface of belt 10. Preferably, magnetic brush development system 38 includes developer roller 40 and 42. Developer rollers 40 and 42 transport a brush of developer material comprising magnetic carrier granules and toner particles into contact with belt 10. The electrostatic latent image recorded on the photoconductive surface of belt 10 attracts the toner particles from the carrier granules forming a toner powder image thereon.

After development, belt 10 advances the toner powder image to transfer station D. At transfer station D, a sheet of support material 44 is moved into contact with the toner powder image. Sheet of support material 44 is advanced to transfer station D by sheet feeding apparatus (not shown). Preferably, the sheet feeding apparatus includes a feed roll contacting the uppermost sheet of the stack of sheets. The feed roll rotates so as to advance the uppermost sheet from the stack into a chute. The chute directs the advancing sheet of support material into contact with the photoconductive surface of belt 10 in a timed sequence so that the powder image developed thereon contacts the advancing sheet of support material at transfer station D.

Transfer station D includes a corona generating device 46 which sprays ions onto the backside of sheet 44. This atrracts the toner powder image from the photoconductive surface to sheet 44. After transfer, sheet 44 moves in the direction of arrow 48 onto a conveyor (not shown) which advances sheet 44 to fusing station E.

Fusing station E includes a fuser assembly, indicated generally by the reference numeral 50, which permanently affixes the transfered toner powder image to sheet 44. Preferably, fuser assembly 50 includes a heated fuser roller 52 and back-up roller 54. Sheet 44 passes between fuser roller 52 and back-up roller 54 with the toner powder image contacting fuser roller 52. In this manner, the toner powder image is permanently affixed to sheet 44. After fusing, a chute guides the advancing sheet 44 to a catch tray for subsequent removal from the printing machine by the operator.

Invariably, after the sheet of support material is separated from the photoconductive surface of belt 10, some residual toner particles remain adhering thereto. These particles are cleaned from the photoconductive surface of belt 10 at cleaning station F. Preferably, cleaning station F includes a cleaning system, indicated generally by the reference numeral 56, which attracts toner particles from the photoconductive surface of belt 10 thereto. Cleaning system 56 includes a cleaning roller 58 which transports a brush of cleaning material comprising magnetic carrier granules into contact with belt 10. As shown in FIG. 1, cleaning roller 58 is positioned such that the brush of cleaning material deforms belt 10 between idler rollers 60 and 62 in an arc. The detailed structure of cleaning system 56 will be described hereinafter with reference to FIGS. 3 and 4. Subsequent to cleaning, a discharge lamp (not shown) floods the photoconductive surface with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 2:
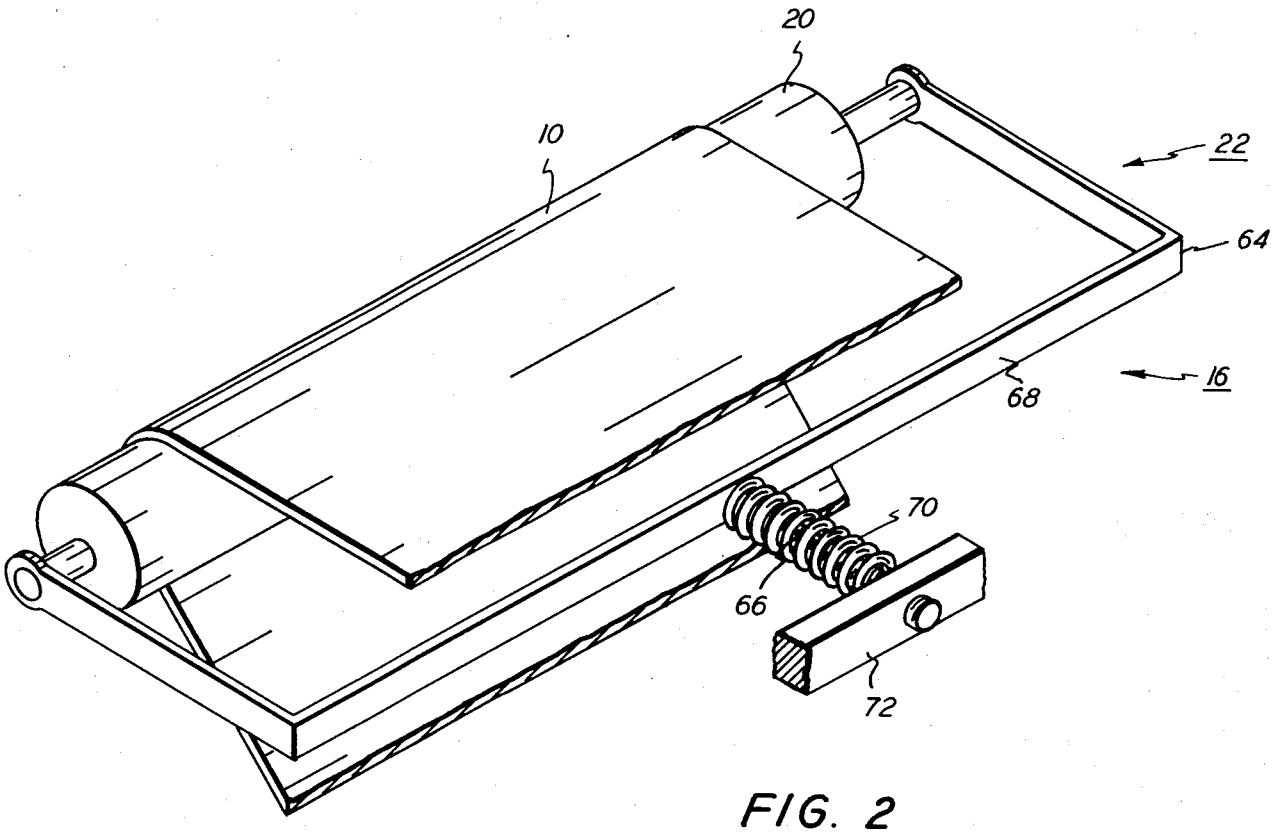
FIG. 2 is a fragmentary, perspective view showing the belt tensioning arrangement for the FIG. 1 printing machine.

Referring now to the specific subject matter of the present invention, FIG. 2 depicts tensioning system 16 in greater detail. As shown thereat, tensioning system 16 includes roller 20 having belt 10 passing thereover. Roller 20 is mounted in a suitable bearing within a yoke, indicated generally by the reference numeral 22. Preferably, yoke 22 includes a U-shaped member 64 supporting the roller 20 and a rod 66 secured to the midpoint of cross member 68 of U-shaped member 64. A coil spring 70 is wrapped around rod 66. Rod 66 is mounted slidably in the printing machine frame 72. Coil spring 70 is compressed between cross member 68 and frame 72. Compressed spring 70 resiliently urges yoke 22 and, in turn, roller 20 against belt 10. Spring 70 is designed to have the appropriate spring constant such that when placed under the desired compression, belt 10 is tensioned to about 0.1 kilograms per linear centimeter. Belt 10 is maintained under a sufficiently low tension to enable the cleaning material on cleaning roller 58 to deflect belt 10 through an arc ranging from about 10° to about 40°.

Figure 3:
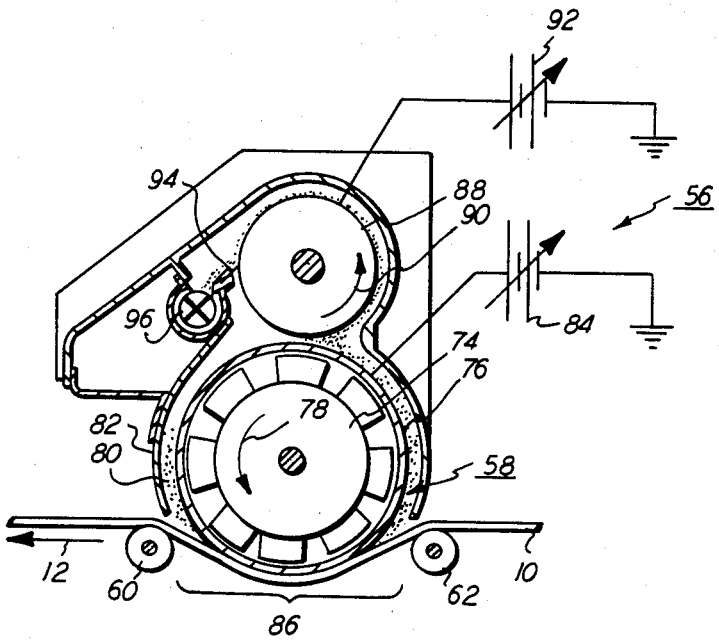
FIG. 3 is an elevational view illustrating the cleaning system used in the FIG. 1 printing machine.

FIG. 3 depicts cleaning system 56 in greater detail. As shown thereat, cleaning system 56 comprises a cleaning roller, indicated generally by the reference numeral 58. Cleaning roller 58 includes a cylindrical magnet 74 having a plurality of magnetic poles disposed about the circumferential surface thereof. A non-magnetic, conductive tubular member 76 is interfit over magnet 74. The interior circumferential surface of tube 76 is spaced from magnet 74. Tube 76 is mounted rotatably. A constant speed motor rotates tube 76 at a substantially constant angular velocity. Preferably, magnet 74 is made from a combination of ceramic and rubber magnets with tube 76 being made from aluminum. Magnet 74 is mounted fixedly and remains substantially stationary as tube 76 rotates in the direction of arrow 78. As tube 76 rotates in the direction of arrow 78, it passes through magnetic particles 80 disposed in housing 82. These magnetic particles are attracted to tube 76. Voltage source 84 is connected to tube 76 and applies a D.C. electrical field thereto. Preferably, the polarity of this field is opposite to that of the toner particles adhering to the photoconductive surface of belt 10 and of a magnitude sufficient to attract the toner particles from the photoconductive surface to the magnetic particles adhering to tube 76. The magnetic particles are selected to that the toner particles have a triboelectric affinity thereto. Preferably, voltage source 84 electrically biases tube 76 to a voltage level ranging from about 0 to about 300 volts. As tube 76 rotates in a constant angular velocity, a brush of cleaning material is formed on the peripheral surface thereof. The brush of cleaning material advances into contact with belt 10 in cleaning zone 86. As previously indicated, the brush of cleaning material in cleaning zone 86 deflects belt 10. Magnet 74 is mounted stationarily to attract magnet particles to tube 76 due to the magnetic properties thereof. The toner particles adhering to the photoconductive surface of belt 10 are electrically attracted to the magnetic particles by the bias voltage applied to tube 76. Thus, in the cleaning zone, the toner particles are attracted from the photoconductive surface of belt 10 to the magnetic particles adhering to tube 76. In this way, the magnetic particles of the cleaning material remove the residual toner particles adhering to the photoconductive surface of belt 10.

Roller 88 is positioned closely adjacent to tube 76. As roller 88 rotates in the direction of arrow 90, it attracts the toner particles from the magnetic particles adhering to tube 76. Voltage source 92 electrically biases roller 90 to the same polarity as voltage source 84 electrically biases tube 76. However, the magnitude of the electrical bias applied by voltage source 92 to roller 88 is greater than electrical bias applied by voltage source 84 to tube 76. For example, the magnitude of the electrical bias applied to roller 88 may range from about 50 to about 500 volts with the specific magnitude selected being greater than the magnitude of electrical bias applied to tube 76. Preferably, roller 62 is made from aluminum having a coating of aluminum oxide thereon.

A metering blade 94 is located closely adjacent to roller 88 for removing the toner particles therefrom. Metering blade 94 deflects or shears the toner particles from roller 88 into a helical auger 96. Helical auger 96 advances these toner particles to a remote station for subsequent reuse in the printing machine development system. By way of example, blade 94 may be made from sheet metal extending across the width of roller 88.

Figure 4:
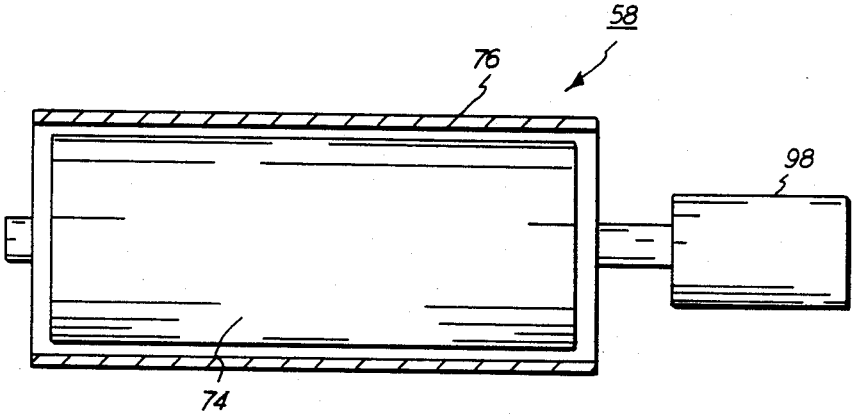
FIG. 4 is an elevational view depicting the cleaning roller of the FIG. 3 cleaning system.

Turning now to FIG. 4, there is shown a drive system for cleaning roller 58. As illustrated thereat, magnet 74 is positioned concentrically and stationarily within tube 76. Tube 76 is coupled to motor 98. Preferably, motor 98 rotates tube 76 at a substantially constant angular velocity. The exterior circumferential surface magnet 74 is spaced from the interior circumferential surface of tube 76. In this way, the magnetic field generated by magnet 74 attracts the cleaning material to the exterior circumferential surface of tube 76. As motor 98 rotates tube 76 in the direction of arrow 78 (FIG. 3), the cleaning material is advanced into cleaning zone 86. The advancing cleaning material contacts belt 10 and deflects belt 10 in an arc. In this way, the cleaning zone is extended about cleaning roller 58 so as to maximize cleaning time. In addition, if charge exchange occurs between the cleaning material and the toner particles, there is a longer time period over which this exchange can occur. In turn, this may allow a greater range of charge input to be cleaned.

In recapitulation, it is clear that the cleaning system of the present invention includes a cleaning roller positioned closely adjacent to the photoconductive surface of a belt so as to transport a cleaning material into contact therewith. The belt is maintained at a pre-selected tension of sufficient magnitude to enable the cleaning material to deflect the belt in the cleaning zone producing an extended cleaning zone. In this way, cleaning time is maximized so as to facilitate the removal of residual particles from the photoconductive surface of the belt.

It is, threfore, evident that there has been provided in accordance with the present invention, an apparatus for cleaning residual particles from the photconductive surface of a belt. The apparatus fully satisfies the advantages and aims herein set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for removing particles from a belt, including:

a tubular member;

means for attracting a cleaning material to said tubular member;

means for rotating said tubular member to transport the cleaning material into contact with the particles adhering to said belt; and means for maintaining the belt at a pre-selected tension of sufficient magnitude so that the belt deflects about said tubular member to form an extended cleaning zone between said tubular member and the belt, said maintaining means tensioning said belt to a magnitude preferably of about 0.1 kilograms per linear centimeter.

2. An apparatus according to claim 1, wherein said belt deflects about said tubular member in an arc ranging from about 10° to about 40°.

3. An apparatus according to claim 2, wherein the cleaning material includes magnetic particles.

4. An apparatus according to claim 3, wherein said attracting means includes an elongated magnetic member disposed interiorally of and spaced from said tubular member.

5. An apparatus according to claim 4, further including means for electrically biasing said tubular member to a polarity and magnitude sufficient to attract the particles from said belt to the cleaning material.

6. An apparatus according to claim 5, further including means for scavenging the particles from the cleaning material adhering to said tubular member.

7. An electrophotographic printing machine of the type having residual particles adhering to a photoconductive belt, wherein the improvement includes:

a tubular member;

means for attracting the cleaning material to said tubular member;

means for rotating said tubular member to transport the cleaning material into contact with the particles adhering to said belt in the cleaning zone; and means for maintaining the photoconductive belt at a pre-selected tension of sufficient magnitude so that the photoconductive belt deflects about said tubular member to form an extended cleaning zone between said tubular member and the photoconductive belt, said maintaining means tensioning said belt to a magnitude preferably of about 0.1 kilograms per linear centimeter.

8. A printing machine according to claim 7, wherein said belt deflects about tubular member in an arc ranging from about 10° to about 40°.

9. A printing machine according to claim 8, wherein the cleaning material includes magnetic particles.

10. A printing machine according to claim 9, wherein said attracting means includes an elongated magnetic member disposed interiorally of and spaced from said tubular member.

11. A printing machine according to claim 10, further including means for electrically biasing said tubular member to a polarity and magnitude sufficient to attract the particles from said belt to the cleaning material.

12. A printing machine according to claim 11, further including means for scavenging the particles from the cleaning material adhering to said tubular member.

13. A method of removing particles from a flexible member, including the steps of:

attracting cleaning material to a tubular cleaning member;

rotating the tubular cleaning member to transport the cleaning material into contact with the particles adhering to the flexible member in the cleaning zone; and maintaining the flexible member at a pre-selected tension having a magnitude preferably of about 0.1 kilograms per linear centimeter so that the flexible member deflects about the cleaning member to form an extended cleaning zone between the cleaning member and the flexible member.

14. A method according to claim 13, wherein said step of tensioning deflects the flexible member about the tubular cleaning member in an arc ranging from about 10° to about 40°.

15. A method according to claim 14, further including the step of electrically biasing the tubular cleaning member to a polarity and magnitude sufficient to attract the particles from the flexible member to the cleaning material.

16. A method according to claim 15, further including scavenging the particles from the cleaning material adhering to the tubular cleaning member.

17. A method of electrophotographic printing in which residual particles adhere to a photoconductive belt, wherein the improvement includes:

attracting cleaning material to a tubular cleaning member;

rotating the tubular cleaning member to transport the cleaning material into contact with the particles adhering to the photoconductive belt in the cleaning zone; and maintaining the photoconductive belt at a preselected tension having a magnitude preferably of about 0.1 kilograms per linear centimeter so that the photoconductive belt deflects about the cleaning member to form an extended cleaning zone between the cleaning member and the photoconductive belt.

18. A method according to claim 17, wherein said step of tensioning deflects the photoconductive belt about the tubular cleaning member in an arc ranging from about 10° to about 40°.

19. A method according to claim 18, further including the step of electrically biasing the tubular cleaning member to a polarity and magnitude sufficient to attract the particles from the photoconductive belt to the cleaning material.

20. A method according to claim 19, further including the step of scavenging the particles from the cleaning material adhering to the tubular cleaning member.

* * * * *